United States Patent [19]

Bartelt

[11] 3,984,064

[45] Oct. 5, 1976

[54] NON-ROTATING PAYOFF STRUCTURE

[75] Inventor: Alan R. Bartelt, West Lafayette, Ind.

[73] Assignee: Aluminum Company of America, Pittsburgh, Pa.

[22] Filed: June 30, 1975

[21] Appl. No.: 591,699

[52] U.S. Cl. ..... 242/129; 242/129.62

[51] Int. Cl.[2] ..... B65H 49/00

[58] Field of Search ..... 242/129, 129.5, 129.53, 242/129.62, 129.72, 137, 137.1

[56] References Cited

UNITED STATES PATENTS

| | | | |
|---|---|---|---|
| 3,249,320 | 5/1966 | Frederick | 242/137.1 |
| 3,298,631 | 1/1967 | Richardson, Jr. | 242/129 |
| 3,485,458 | 12/1969 | Evans | 242/129 |

*Primary Examiner*—Leonard D. Christian
*Attorney, Agent, or Firm*—Elroy Strickland

[57] ABSTRACT

A low-cost structure for paying off elongated product in a non-rotating manner from stationary, unhoused coil supplies of the product. The structure comprises a horizontally disposed base and a vertically disposed, rigid, open shroud or cowling adapted to receive at least one coil supply of said product. A curved guide is employed having a lower end located over the substantial center of the base for receiving product directly from a coil supply thereof located on the base. The upper end of the guide is located to face in a horizontal direction and in the direction of the pass line of the product to be pulled from the supply thereof.

5 Claims, 4 Drawing Figures

NON-ROTATING PAYOFF STRUCTURE

BACKGROUND OF THE INVENTION

The present invention relates generally to a structure for paying off elongated material in a non-rotating manner, and particularly to structures for simultaneously paying off large, heavy coil packages of small diameter tubing, though the invention is not limited thereto.

There is a substantial amount of patent art directed to paying off coiled supplies of elongated products in a non-rotational manner, including coiled supplies of tubing, such as shown in the Martin U.S. Pat. No. 3,857,269. The Martin patent, however, is directed to paying off relatively large, cross sectional diameter tubing and therefore requires a long tower or cage located adjacent the supply of the tubing to guide the same to a process location in a manner that prevents knotting or kinking of tube.

In contrast to the type and size of the apparatus disclosed in the Martin patent, there are patents teaching the use of small, non-rotating, boxed units of electrical wire, such as shown in the Evans and Zerg et al. U.S. Pat. Nos. 3,304,025 and 3,485,458, the boxes of wire being mounted in portable racks. such apparatus is particularly suitable for electrical contractors needing movable, ready available supplies of wire, but are wholly unsatisfactory for handling large, heavy packages of coiled, elongated product for processes needing continuous lengths of the product.

Other structures for paying off wire from non-rotating supplies thereof are shown in U.S. Pat. Nos. 793,688, 2,286,460, 3,091,415, 3,282,304, 3,298,631 and 3,744,734 issued, respectively, to Smith, Brown, Magna, Coleman, Richardson and Ladato et al. As will become apparent in the description of the present invention that follows the background information presented here, none of the structures disclosed in these patents provide the simplicity and economy provided by the structure that forms the subject matter of the present application.

Thus, the problem in the area of the subject invention has not been a general lack of background technology, but rather the lack of effort to develop low-cost, payoff structures that are simple and inexpensive to fabricate and yet simultaneously provide efficiencies in operation and savings in space that are attractive to manufacturers requiring large supplies of coiled, elongated products in processes needing continuous lengths of the elongated product. As can be appreciated, research and development efforts are often quite costly such that an industry, because of a shortage of capital, for example, often does not pursue such research and development efforts. The industry thus continues to function with less than desirable equipment and apparatus.

In the air conditioning industry, for example, with the changeover from copper tubing to aluminum tubing, the industry, heretofore, has generally lacked payoff apparatus that was suitable for handling large, unboxed, coil packages of the lighter weight aluminum material, the large packages providing substantial increases in productivity and savings in handling the packages. The large packages provide amounts (miles) of tubing that require less labor and less machine downtime because there is less need to stop machines and processes for replenishing supplies of tubing. Other economic advantages flow from the fact that less storage space is required for the large, unboxed packages.

A further enhancement of the payoff problem in the industry using large amounts of metal tubing has been the use of machines and processes that require the simultaneous feeding of several strands of tubing. For example, bending machines are available that can simultaneously cut and bend up to 6 and even 12 items of tubing. Payoff apparatus that can continuously simultaneously supply tubing to such machines is required, particularly in an inexpensive, efficient manner, and in a manner requiring minimum of floor space.

BRIEF SUMMARY OF THE INVENTION

The present invention is directed to apparatus for paying off elongated product material, such as large coils of metal tubing, in a non-rotating manner, using a structure that is simple and easy to fabricate, and that utilizes low-cost, inexpensive parts that are readily available or easily made, and are quickly assembled together requiring the use of relatively unskilled personnel. Briefly, the structure of the invention uses a flat plate or piece of metal as a base for receiving a coiled supply of an elongated product, and an open cowling or shroud suitably attached to the periphery of the flat plate, the cowling preferably having a circular contour that extends less than half the distance around the general area occupied by the coiled product. This limited extent of the cowling provides open, easy access for setting a coiled supply of product into place on the base and adjacent the cowling.

Fixed on a simple bar or pipe structure located above the base and cowling is a vertically disposed, curved guide means having its lower end located substantially over the center of the base, and its upper end facing in a horizontal direction and in the direction of the pass line of the product to be directed from the base and cowling. The curved guide means is mounted on at least one vertically disposed hinge so that it can be rotated out of the way of a hoist chain employed to transport the coil package before the package is disposed on the base. After the package is set into place on the base, the guide means is swung back into place over the center of the coiled supply. Immediately beneath the curved guide are located bar means employed to prevent the occurrence of tubing entanglements in front of the curved guide as elongated product is pulled from the coil package thereof.

BRIEF DESCRIPTION OF THE DRAWINGS

The objectives and advantages of the subject invention will be best understood from consideration of the following detailed description when read in connection with the accompanying drawings in which.

DETAILED DESCRIPTION OF THE DRAWINGS

Figure 1:
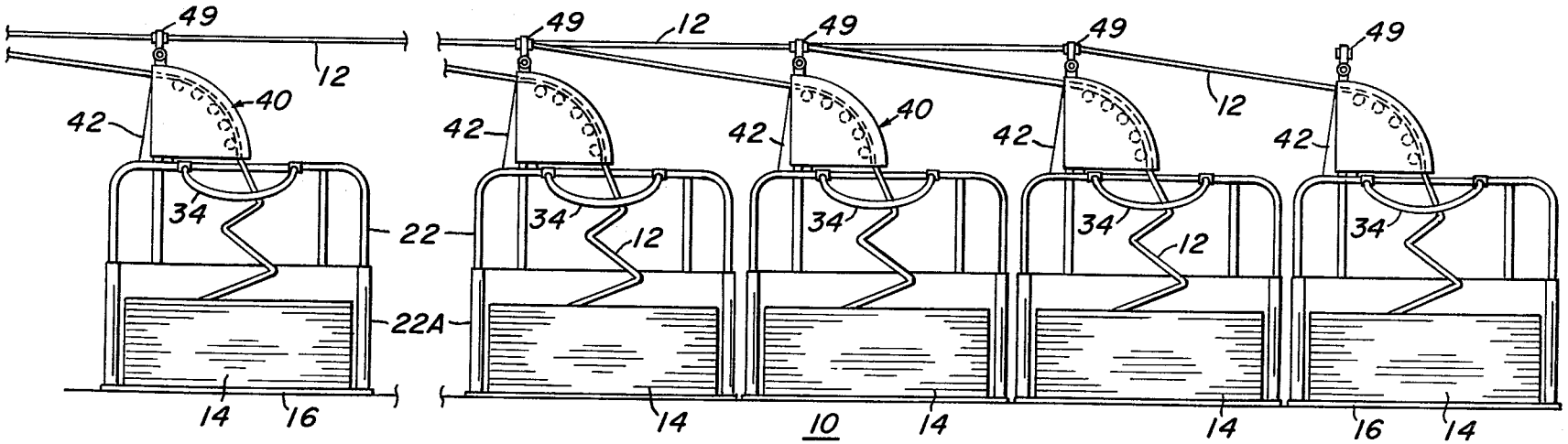
FIG. 1 is a front elevation view showing a row of five structures for simultaneously paying off elongated product from five stationary supplies thereof in accordance with the principles of the present invention.

Referring now to the drawings, FIG. 1 shows in elevation a single row of five relatively simple, inexpensive structures 10 for simultaneously paying off elongated product 12 from five, non-rotating stationary coiled supplies 14 of the product to a work station and process location not shown. The row of units 10 may include more or less than five units, and two back to back, rows of the units may be conveniently employed to supply processes and apparatus requiring simultaneously a number of product feeds larger than that provided by a single row.

The five supplies of product 12 may be supplies of relatively small diameter tubing to be simultaneously fed to apparatus (not shown) for simultaneously cutting the tubing into finite lengths and then simultaneously bending the cut lengths into U-shaped tubes for air conditioning units, though the invention is not limited thereto. Further, as indicated in the drawings, each coiled supply is unhoused; for shipping and handling purposes the integrity of the coil can be maintained by bands or straps (not shown) extending around the cross section of the coil.

The structures 10 each include a simple flat base 16 that can be attached to the floor of a building, if desired, and a rigid, open cowling or shroud 18 suitably joined to the flat base to form a unitary structure therewith. The shroud is preferably located on the periphery of the base and at the rear thereof so that the shroud does not obstruct the setting of a coiled supply of product on the base. For this reason, also, it is preferable that the shroud extends less than half the distance about the area occupied by the coil, as best seen in FIGS. 2 and 3 of the drawings.

Figure 2:
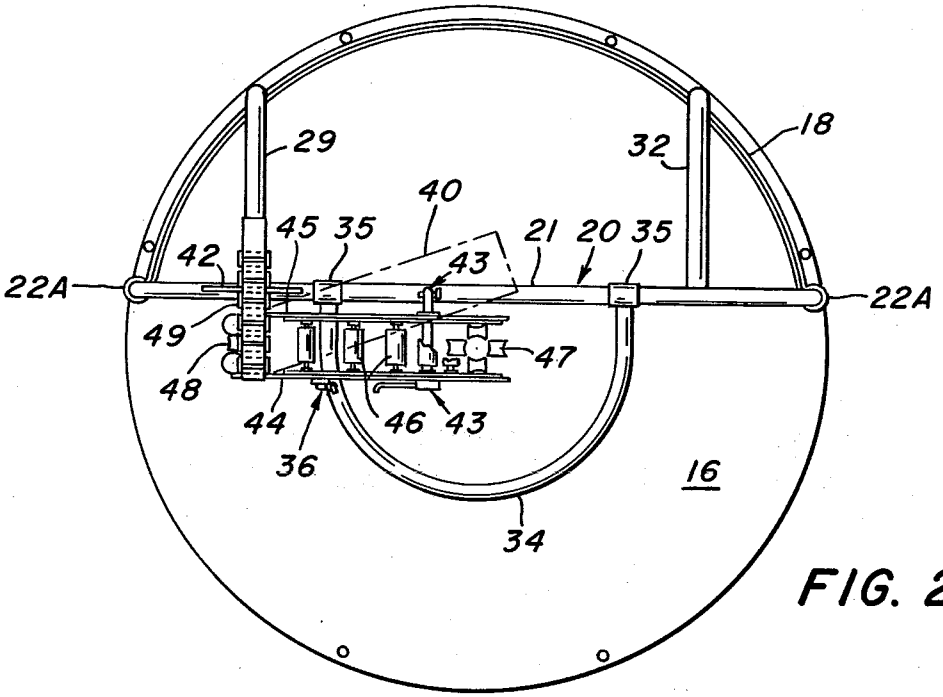
FIG. 2 is a top plan view of one of the structures shown in FIG. 1.
Figure 4:
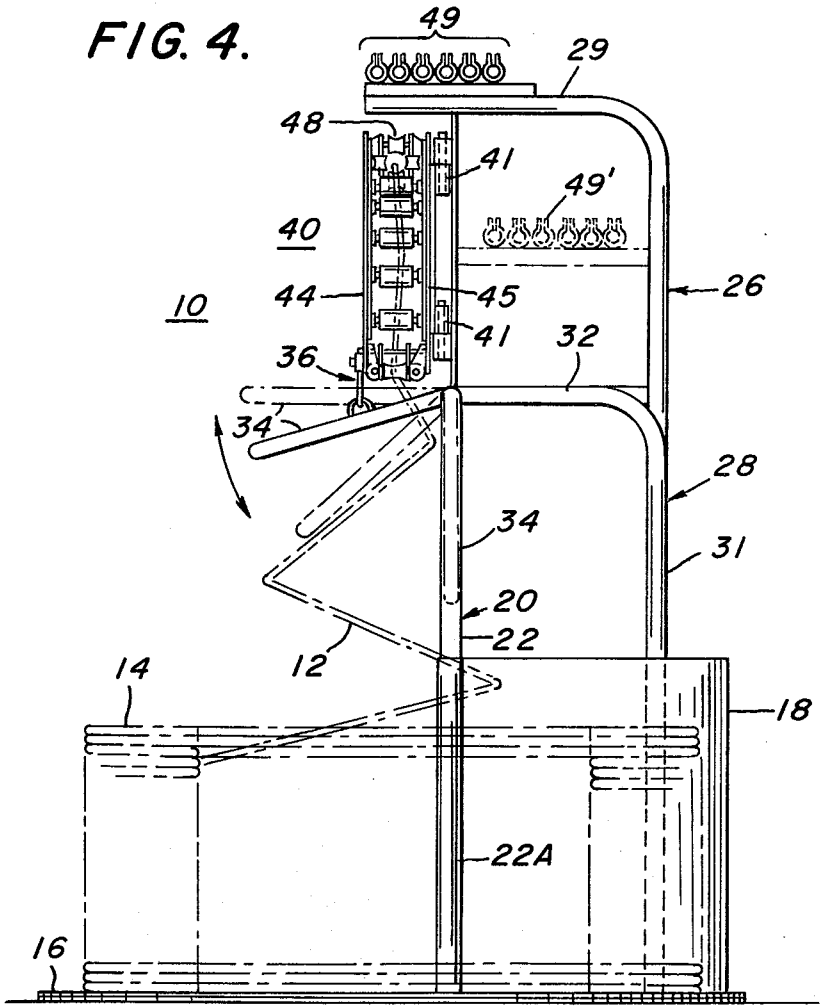
FIGS. 3 and 4 are respectively front and side elevation views of the one structure of FIG. 2.
Figure 3:
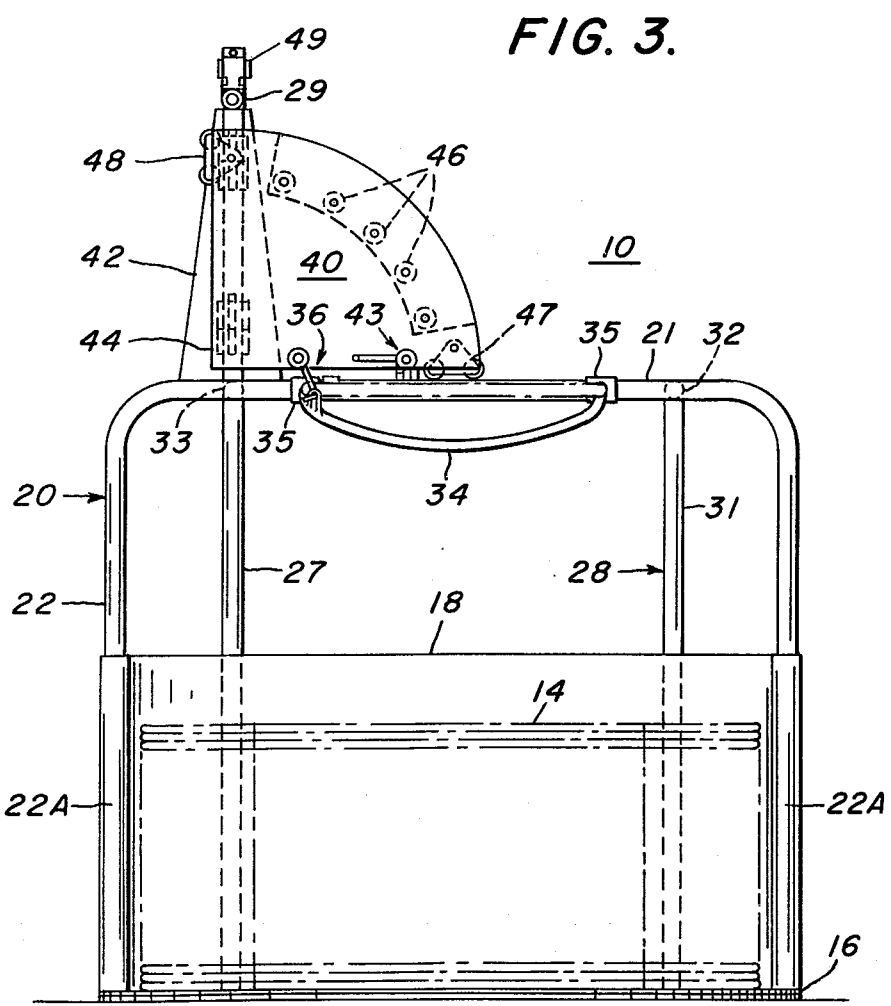

As shown in FIGS. 2 to 4, a single, rigid, U-shaped bar 20 extends up from base 16 and shroud 18, and has a horizontal portion 21 (FIG. 3) that spans the distance between the extremities of the shroud. The horizontal portion 21 is located a distance above the base 16 sufficient to allow ease of access in the process of setting the coil package 14 in place, and in close proximity to a curved guide 40 for reasons explained hereinafter. Bar 20 can be secured in place by welding vertical legs 22 of bar 20 to the shroud, the shroud extending to the location of the vertical legs.

In addition to the structure of bar 20, two additional bars 26 and 28 extend vertically up from the rear of the base and shroud and horizontally over the base to lend additional structure rigidity toi the payoff units 10 of the invention in a manner presently to be explained, with bar 28 providing additional functions described hereinafter.

More particularly, bar 26 has a portion 27 extending vertically from base 16 on the rear, outside surface of the shroud, and a horizontal portion 29 located a substantial distance above the base and extending forwardly over the base to a location beyond the extent of the bar 20. Similarly, bar 28 has vertically and horizontal portions 31 and 32 (FIG. 4), with horizontal portion 32 being lower than that of bar 26, and extending to the horizontal portion 21 of bar 20. The end of horizontal portion 31 is joined to the horizontal portion 21 or bar 20, such as by welding, to form a strong, rigid connection between the two bars. Similarly, the ends of bars 26 and 28 may rest on the edge or periphery of base 16 and be welded thereto and/or to shroud 18.

A horizontal bar 33, one end of which is seen only in hidden outline in FIG. 3, extends between and is suitably joined to the vertical portion 27 of bar 26 and the horizontal portion 21 of bar 20 at substantially the same height as the horizontal portion 32 of bar 28. With bars 26, 28 and 33 joined between bar 20 and shroud 18, the unit 10 is structurally balanced and rigidly secured together. Further, it can be appreciated that the configuration of the shroud 18 provides a rigid structure for supporting bars 20, 26 and 28 while simultaneously limiting the possibility of damaging the coil package when the package is placed on base 16. In this latter regard, the base and shroud can be provided with carpeting or other suitable padding material to prevent damage to the coiled supply of product in the process of setting the coil in place. The padding of the shroud may extend around the vertical protions 22 of bar 20, as indicated by numeral 22A.

For purposes explained hereinafter a U-shaped bar 34 is rotatably attached to the horizontal portion 21 of bar 20. This can be accomplished by the use of two simple rings or cylinders 35 welded or otherwise suitably attached to the respective ends of bar 34. The bar is held in a substantially horizontal position by a hook and eye structure generally designated 36 in FIG. 4.

Located over each base and horizontal bar 34 is a guide structure 40 having a curved configuration providing a 90° bend, the guide structure being vertically disposed such that its lower end is located on substantial center of the base 16, and its upper end faces in a generally horizontal direction and in the direction of the pass line of tubing 12 to be pulled from the supply 14 thereof positionable on base 16. The guide structure is rotatably or swingably mounted, by hinges 41, on a plate 42 extending between the upper horizontal bar portion 29, as best seen in FIG. 4, and lower horizontal bar portion 21. In FIG. 3 the base of plate 42 is shown centered about bar 33, with the upper and lower edges of the plate being joined respectively to bar portions 29 and 21, such as by welding. This provides a structurally sound support for the curve guide. The wings of hinges 41 are suitably attached to the plate 42 and to the rearwardly facing surface of the curved guide, with the axes of the hinges extending in a generally vertical direction.

Since the guide structure 40 is mounted on hinges that permit movement of the structure about the axes of the hinges, the structure is held in place in the pass line of its associated payoff unit by a suitable, simple latch means generally designated by numeral 43 in FIGS. 2 and 3.

The guide structure itself is economically constructed and includes, as shown in FIGS. 2 and 4, a two, simple, parallel plates 44 and 45 spaced apart by a curved array of inexpensive rollers 46, 47 and 48. Rollers 46 can be single roll devices having center shafts respectively extending into and suitably secured in a curved array of holes provided in each of the parallel plates. As best seen in FIG. 3, the lowermost, entrance roller (47) is located over the substantial center of the base and coiled supply of product, while the uppermost, exit roller (48) is spaced from the axial center of the base and coiled supply, and at a predetermined height above that of the lowermost roller. The lowermost and uppermost rollers 47 and 48 are preferably plural roller devices to insure proper entrance and exit conditions for the product 12 to be directed from the units 10.

Above the curved guide 40, and fixedly attached to the horizontal bar portion 29 of a particular payoff unit 10, as shown in all of the figures, or behind the curved guide 40, as shown in dash outline in FIG. 4 only, is disposed at least one simple eye structure 49 (or 49') for guiding the elongated product 12 from the payoff unit or units preceding the particular unit in the progress of the travel of the product to a process station. The number of eye structures on any particular payoff unit 10 is dependent upon the number of such units preceding it. For example, the unit most remote from the process location need not have an eye guide at all, while the unite closest to the process station has an array of eye guides, such as shown in FIG. 4.

If a pass line is needed or desired that is lower than the pass line provided by the eyes 49 mounted on bar 29, the eyes (49') can be located behind support plate 42 in the manner shown in dash outline in FIG. 4. If yet a lower pass line is desirable or required, the eyes may be mounted on horizontal bars 32 or 33.

Before proceeding to a description of the use of units 10 of the present disclosure, it should be emphasized that the units 10 are made from readily available and easily fabricated components that are simply and economically put together to provide effective and efficient payoff structures for process requiring large amounts of simultaneously fed, elongated product. The bar structures 20, 26, 28, 33 and 34, for example can be ordinary pipe stock or other tubular or bar structure, while the shroud and base are simple plate structures easily made and dimensioned for the largest size of coil package 14 to be paid off. The relatively few pipe or bar connections required in each unit can be effected primarily by welding.

To use the units 10, the units are aligned in a straight row, as suggested in FIG. 1, the number of the units being dependent upon the need or capacity of the process and apparatus to be fed. For example, if the units 10 are used to feed a machine capable of cutting and bending six tubes at one time, such as a model VBHB-M3 hairpin bender made by Burr oak Tool and Gauge Company of Sturgis, Mich., then six units 10 are required, the units being aligned with the feed end of the machine. A package of coiled tubing 14 is then placed on each base 16, and the end of tubing 12 on the inside of each coil is grasped and directed through its associated curved guide 40 and through the eyes 49 (or 49'), of the succeeding units 10, located in the pass line of the tubing. From the last array of eyes, i.e., the eyes closest to the hairpin bender or other apparatus to be fed, the end of each tube is directed into a pulling mechanism for the bender or other apparatus. In this manner, initial setup and threading of the tubing from all supplies thereof is readily effected before beginning the process using the tubing. With all of the tubings thus threaded, a parallel array of tubing is strung above or beside each pay off guide 40 ready to be simultaneously pulled into the process and apparatus utilizing the tubing. As coil packages are depleted in the process, new packages are quickly and easily placed in the emptied units 10, and threaded to the processing apparatus.

Before setting a coil package in place on a base 16, the rotatable bar 34 associated therewith is unhooked at 36 to swing down (see FIG. 4) and out of the way of a chain for the overhead hoist (not shown) carrying the package as it is brought into place on the base. Similarly, the latch mechanism 43 holding the curved guide 40 in general alignment with the pass line of the tubing is released and the guide is swung out of the way of the overhead hoist chain, as shown in dash outline in FIG. 2. This simplifies the operation of placing the package 14 in the units 10 by clearing the path of approach to base 16. After the package is disposed in place, the bar 34 is rotated up and hooked in place (be 36) and the curved guide 40 is swung back into place over the center of the package, and locked into position by latch 42. With the package in place, the end of the tubing on the inside is grasped and directed through the guide and eyes, as explained earlier, in preparing for the feeding operation.

During the feeding operation both bar 21 and 34 serve to confine the tube strand, as it is pulled from the coil package 14, and to prevent entanglements and knots in the tubing as it enters the entrance rollers 47 of guide 40.

In the process of depleting each coiled supply of tubing, the final coils or loops of each supply are lifted from base 16. These loops tend to move and fly about before entering the curved guide 40. The U-shaped bar or pipe 34 serves to constrain this movement so that the tubing can enter into the curved guide 40 without damaging itself as well as personnel who might be near the payoff units as they are being depleted.

The structures 10 occupy a minimum of factory floor space and have a relatively low profile so that they can be used in buildings having relatively low ceilings. For example, to handle a 445 pound coil of ⅜-inch outside diameter, 0.035 wall thickness, relatively soft aluminum tubing, the diameter of each base 16 is on the order of only 48 inches, and the height of each unit, measuring from floor level to the top of eye structures 49, is approximately 68 inches. With guides 49' in the position of FIG. 4 (or lower), the pass line height is substantially less than 60 inches.

While the invention has been described in terms of perferred embodiments, the claims appended hereto are intended to encompass all embodiments which fall within the spirit of the invention.

Having thus described my invention and certain embodiments thereof, I claim:

1. A unitary, low cost, simple structure for simultaneously paying off elongated product from a plurality of stationary, unhoused, coiled supplies of the product in a non-rotating manner, said structure comprising at least one row of aligned, bar or tubular frames respectively associated with horizontally disposed bases and vertically disposed, arcuate shrouds or cowlings respectively attached to said bases and adapted respectively to receive the unhoused supplies of product, said shrouds or cowlings being open in a forwardly facing direction and at the upper end thereof, and extending upwardly to a location intermediate the height of the bar or tubular frame, and, a curved guide structure associated with each shroud and base having a lower end located over the substantial center of each base, with the other end of each guide structure facing in a horizontal direction and in alignment with the row of aligned bases and shrouds.

2. The structure of claim 1 in which each base and shroud has associated therewith one or more fixed eye means located above each base and shroud, the number of eye means associated with any one base and shroud being dependent upon the number of bases and shrouds preceding the one base and shroud, with the axis of each eye means being aligned with a generally horizontal pass line of elongated product to be directed from a supply of the product to be received on the base immediately preceding the eye means in the row of bases and shrouds.

3. In a low cost, simple structure for paying off elongated product in a non-rotating manner from a stationary, unboxed, coiled supply of the product, said structure comprising a horizontally disposed base and a vertically disposed, rigid, open shroud or cowling attached to said base and extending only part way around the periphery thereof, at least one curved guide structure having a lower end located and substantially centered over the base for receiving product directly from a coiled supply thereof receivable on said base, with the other, upper end of the guide structure facing in a horizontal direction and in the direction of the pass line of the product to be pulled from the supply thereof receivable on the base, a fixed, rigid bar having a horizontal portion located over the base and the supply of product receivable on the base, and, a movable bar having a semicircular configuration in plan view located substantially over the center of the base immediately beneath the lower end of the curved guide structure, said movable bar being rotatably mounted on the horizontal portion of said fixed bar.

4. In a low cost, simple structure for paying off elongated product in a non-rotating manner from a first, stationary, unboxed, coiled supply of the product, said structure comprising a horizontally disposed base and a vertically disposed, rigid, open shroud or cowling attached to said base and extending only part way around the periphery thereof, at least one curved guide structure having a lower end located and substantially centered over the base for receiving product directly from a coiled supply thereof receivable on said base, with the other, upper end of the guide structure facing in a horizontal direction and in the direction of the pass line of the product to be pulled from the supply thereof receivable on the base, and, at least one eye means located above the base and shroud, and adjacent the upper end of the curved guide structure, with the axis of the eye means being in line with the pass line of a second elongated product to be directed from a second payoff structure preceding the first supply of product.

5. In a low cost, simple structure for paying off elongated product in a non-rotating manner from a stationary, unboxed, coiled supply of the product, said structure comprising a horizontally disposed base and a vertically disposed, rigid, open shroud or cowling attached to said base and extending only part way around the periphery thereof, at least one curved guide structure having a lower end located and substantially centered over the base for receiving product directly from a coiled supply thereof receivable on said base, with the other, upper end of the guide structure facing in a horizontal direction and in the direction of the pass line of the product to be pulled from the supply thereof receivable on the base, and, means mounting the curved guide structure to rotate about a vertically extending axis.

* * * * *

UNITED STATES PATENT AND TRADEMARK OFFICE

CERTIFICATE OF CORRECTION

PATENT NO. : 3,984,064
DATED : October 5, 1976
INVENTOR(S) : Alan R. Bartelt

It is certified that error appears in the above-identified patent and that said Letters Patent are hereby corrected as shown below:

| | |
|---|---|
| Col. 1, line 27 | Change "such" to --Such--. |
| Col. 2, line 12 | After "minimum" insert --use--. |
| Col. 3, line 44 | Change "toi" to --to--. |
| Col. 3, line 57 | After "21" change "or" to --of--. |
| Col. 5, line 6 | Change "unite" to --unit--. |
| Col. 5, lines 22-23 | Change "struc-ture" to --struc-tures--. |
| Col. 5, line 34 | Change "oak" to --Oak--. |
| Col. 5, line 68 | Change "(be 36)" to --(by 36)--. |

Signed and Sealed this

Fourteenth Day of December 1976

[SEAL]

*Attest:*

RUTH C. MASON
*Attesting Officer*

C. MARSHALL DANN
*Commissioner of Patents and Trademarks*